United States Patent [19]

Estwanik, III

[11] Patent Number: 4,561,547

[45] Date of Patent: Dec. 31, 1985

[54] SUSPENDIBLE STORAGE ASSEMBLY

[76] Inventor: Joseph J. Estwanik, III, 1925 Clematis Dr., Charlotte, N.C. 28211

[21] Appl. No.: 536,541

[22] Filed: Sep. 28, 1983

[51] Int. Cl.[4] ..... A47F 5/08; A47F 7/00

[52] U.S. Cl. ..... 211/14; 211/13; 211/113; 211/60.1

[58] Field of Search ..... 211/14, 113, 118, 123, 211/13, 129, 60 R, 117, 70; 108/149, 96; 248/317, 328, 318, 327

[56] References Cited

U.S. PATENT DOCUMENTS

| | | | |
|---|---|---|---|
| 2,064,826 | 12/1936 | Gabriel | 248/318 X |
| 2,972,419 | 2/1961 | Zelen et al. | 248/317 X |
| 2,997,217 | 8/1961 | Levy | 248/328 X |
| 3,382,819 | 5/1968 | Deutsch et al. | 108/149 X |
| 3,729,092 | 4/1973 | Marcell | 248/317 X |
| 3,915,419 | 10/1975 | Brown et al. | 248/318 |
| 4,121,720 | 10/1978 | Hayes | 211/113 |
| 4,181,234 | 1/1980 | Feighan | 211/113 X |
| 4,214,684 | 7/1980 | Galowitz | 211/14 X |
| 4,244,301 | 1/1981 | Nakatsu | 211/113 X |
| 4,380,296 | 4/1983 | Murray et al. | 211/10 X |

FOREIGN PATENT DOCUMENTS

| | | | |
|---|---|---|---|
| 327355 | 4/1930 | United Kingdom | 211/113 |

*Primary Examiner*—Robert W. Gibson, Jr.

*Attorney, Agent, or Firm*—Bell, Seltzer, Park & Gibson

[57] ABSTRACT

A suspendible storage assembly for containment of various sports equipment and the like during nonuse is provided wherein a plurality of vertically spaced apart platforms cooperate with a plurality of elongate pliable supporting means, some of which are extensible so that sports equipment may readily be placed on and removed from the platforms by stretching and laterally deflecting the extensible supporting means.

16 Claims, 11 Drawing Figures

SUSPENDIBLE STORAGE ASSEMBLY

FIELD AND BACKGROUND OF THE INVENTION

The present invention relates to a storage assembly which can contain various sports equipment such as basketballs, soccer balls, tennis balls and the like and which may be suspended from the ceiling of a room or garage in order to effectively utilize available space. Typically, such equipment is stored in closets, drawers or containers. This means of storage requires floor space and items of furniture with side walls, which is a wasteful means of storage. Moreover, baskets or flat shelves which are capable of being suspended do not provide an effective way of retaining sports items of various shapes and sizes in the entire space between the shelves or baskets.

SUMMARY OF THE INVENTION

With the foregoing in mind, it is a primary object of this invention to provide a storage assembly which can contain or have hung therefrom various sports items and the like during nonuse which may be suspended above a floor in order to more effectively utilize available space in an area such as a room or a garage.

A further object of the invention is to provide a storage assembly having a plurality of platforms in which all of the space above each platform may be utilized.

A further object of the invention is to provide a low cost, lightweight storage assembly of sturdy construction In accordance with this invention, a suspendible storage assembly for containment of various sports equipment during nonuse is provided with a plurality of vertically spaced apart platforms cooperating in a multi-tiered assembly by means of a plurality of spaced apart elongate pliable supporting means and wherein some of the supporting means are extensible so that the sports items may be readily removed from the platforms or placed thereon by stretching and laterally deflecting the extensible supporting means.

BRIEF DESCRIPTION OF THE DRAWINGS

Some of the objects and advantages of the invention having been stated, others will appear as the description proceeds, when taken in connection with the accompanying drawings, in which.

DETAILED DESCRIPTION

Figure 1:
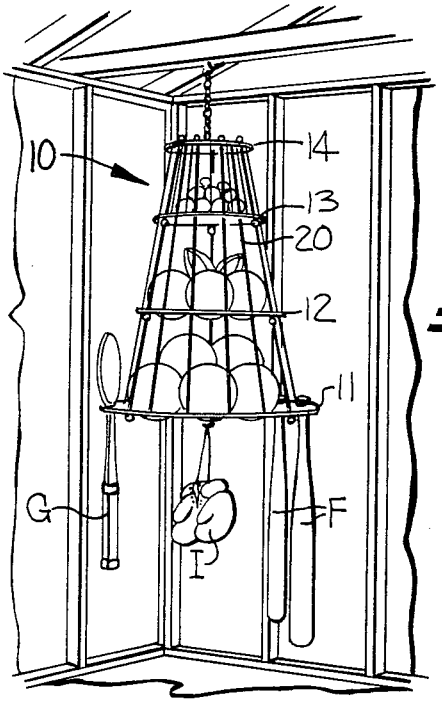
FIG. 1 is a perspective view of the storage assembly suspended in a garage.

Referring more specifically to the drawings, the suspendible storage assembly, broadly identified by numeral 10, is illustrated in FIG. 1 suspended in the corner of a garage with sports equipment contained therein and hung therefrom. From this figure, it may be seen that the storage assembly 10 provides for storage of various sports items during nonuse in an organized manner and utilizes space that otherwise would not normally be used.

Figure 2:
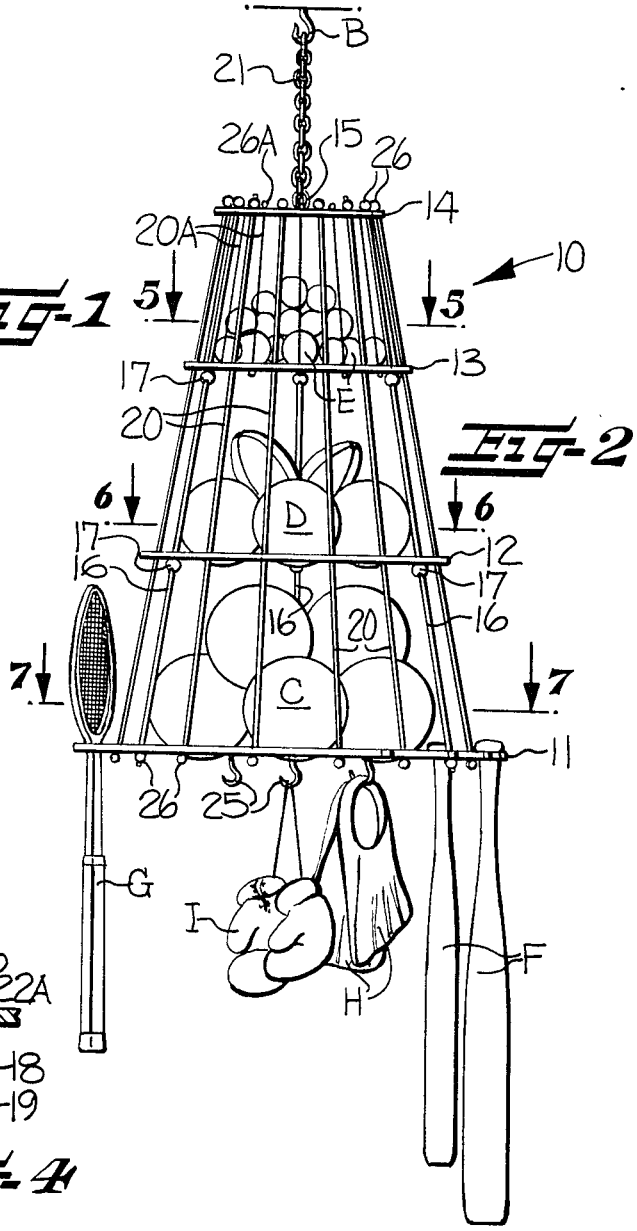
FIG. 2 is a side elevational view of the storage assembly containing various sports items.

FIG. 2 illustrates a preferred embodiment of the storage assembly 10 in greater detail. It will be observed that the storage assembly 10 is provided with three vertically spaced apart platforms 11, 12 and 13 of decreasing size from lowermost platform 11 to uppermost platform 13. These platforms are illustrated as being flat and are arranged such that the centers of the platforms 11–13 are in vertical alignment. The platforms 11–13 are maintained in position by at least three elongate, inextensible pliable members 16 adjacent the periphery of the platforms 11–13 and are substantially uniformly spaced apart from each other. A plurality of extensible pliable members 20 are interspersed among the inextensible pliable members 16. The spacing and arrangement of pliable members 16 and 20 collectively are such as to serve as a fence for retaining sports equipment on the platforms 11–13. This permits utilization of all of the space above each of the platforms 11–13. The extensible pliable members 20 are adapted to be stretched and laterally deflected to facilitate passage of sports items of greater diameter than the distance between the various pliable members 16 and 20 so that the items readily may be placed onto and removed from the platforms 11–13. The inextensible pliable members 16 and the extensible members 20 are convergingly arranged from the lowermost platform 11 to the uppermost platform 13.

The storage assembly 10 is provided with a suspension plate 14 to which the upper portions of the elongate pliable members 16 and 20 are attached. A closed loop 15 is connected to the center of the suspension plate 14 to enable the storage assembly 10 to be suspended. As depicted in FIG. 2, the storage assembly 10 is suspended from a hook B by means of a chain 21.

As depicted in FIG. 2, balls C–E are contained on the platforms such that the balls of the greatest diameter are contained in the lowermost platform 11 and are of generally decreasing diameter to the uppermost platform 13. It will be observed that shorter extensible members 20A have been provided between the uppermost platform 13 and the suspension plate 14 only so that balls E of small diameter, such as tennis balls, may be maintained on and above the uppermost platform 13.

Further illustrated in FIG. 2 are end retainers 26 and 26A which are attached to the ends of all extensible pliable members 20 and 20A respectively in order to maintain the extensible pliable members 20 and 20A in a slightly stretched normal position to allow the extensible pliable members 20 and 20A to be deflected for placement or removal of various sports items from the platforms 11–13.

Figure 3:
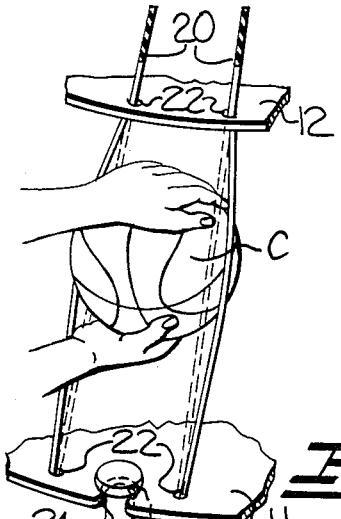
FIG. 3 is an enlarged fragmentary view showing how the extensible supporting members are deflected in order for a ball to be placed upon a platform of the storage assembly.

As illustrated in FIG. 3, a ball C with a diameter greater than the distance between extensible members 20 can be placed onto the platform 11 by stretching and laterally deflecting the extensible pliable members 20. Once the ball C has been placed onto the platform 11, the extensible members return to their natural state so as to assist in maintaining the ball C on the platform 11.

Figure 4:
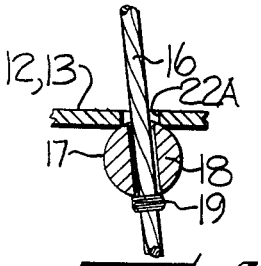
FIG. 4 is a sectional view illustrating an abutment stop on an inextensible member of the storage assembly.

As depicted generally in FIG. 2 and more particularly in FIG. 4, an abutment stop 17 on each of the inextensible pliable members 16 is positioned under each of the platforms 11–13 in order to support the platforms 11–13 in substantially level position in the multitiered assembly. As shown in FIG. 4, the abutment stop 17 includes a beadlike member 18 with a bore therethrough which is slidably mounted on inextensible pliable members 16 and maintained in position by windings of cord 19 thereunder.

Figure 5:
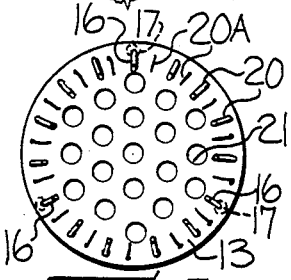
FIG. 5 is a sectional plan view taken along the line 5—5 of FIG. 2 illustrating the arrangement of apertures in the uppermost platform of the storage assembly.
Figure 6:
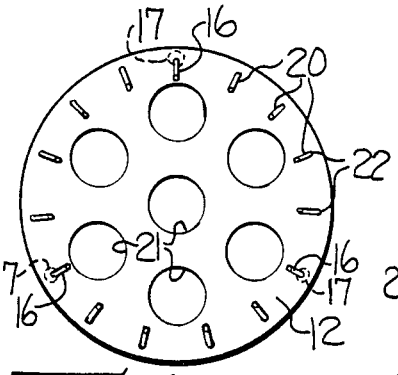
FIG. 6 is a sectional plan view taken along the line 6—6 of FIG. 2 illustrating the arrangement of apertures in the middle platform of the storage assembly.
Figure 7:
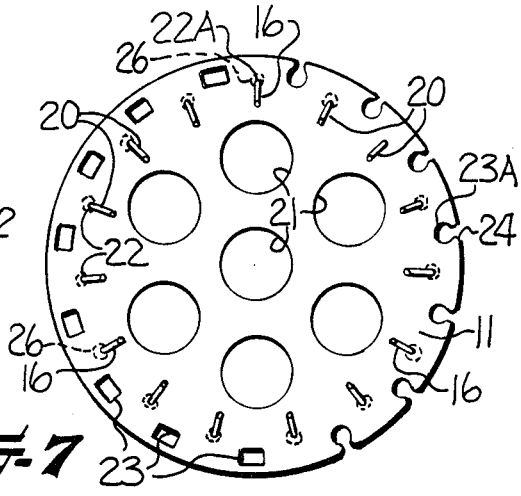
FIG. 7 is a sectional plan view taken along the line 7—7 of FIG. 2 illustrating the arrangement of apertures in the lowermost platform of the storage assembly.

The platforms 11–13 of the preferred embodiment depicted in FIGS. 5–7 are provided with spaced apart apertures 21 of decreasing diameter from the lowermost platform 11 to the uppermost platform 13. The apertures 21 are provided to receive portions of balls C–E so as to stabilize the balls C–E and prevent them from freely moving about on the platforms 11–13. The diameters of the apertures 21 are less than the diameters of the balls C–E respectively so that the balls C–E are retained on the platforms 11–13 and do not pass through the apertures 21. The apertures 21 in the lowermost platform 11 are about 5 inches or less, and the apertures 21 in the platforms 12–13 thereabove are of lesser diameter. It should further be observed that the apertures 21 in all of the platforms 11–13 are spaced inwardly of the extensible pliable members 20 and inextensible pliable members 16, and the number of apertures in the uppermost platform 13 is greater than those of the lowermost platform 11.

Additionally depicted in FIGS. 5–7 are circular rows of openings 22 spaced inwardly from the respective peripheries of the platforms 11–13 for passage of the extensible pliable members 20 loosely therethrough. In this manner the extensible pliable members 20 may be more easily stretched and laterally deflected for passage of sports items therethrough. It will also be observed in FIGS. 5–7 that the openings 22A correspond to the positioning of the inextensible pliable members 16.

Further illustrated in FIG. 7 are openings 23 and 23A adjacent the periphery of the lowermost platform 11 which are adapted to receive handles of tennis rackets G and bats F and the like for storage purposes. Restricted access passageways 24 communicate with the periphery of the lowermost platform 11 for facilitating placement and removal of bat F and racket G handles and the like in the openings 23A. Additional sports items, capable of being suspended during nonuse, such as swim fins H and boxing gloves I, are depicted in FIG. 2 suspended from hook means 25 carried by the lowermost platform.

Figure 8:
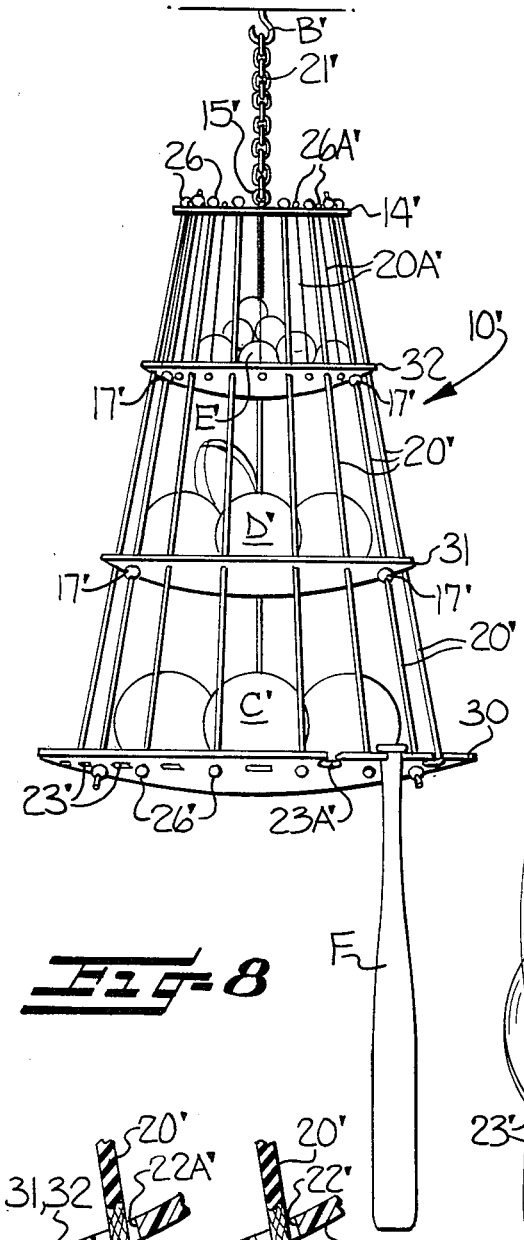
FIG. 8 is an elevational view of the storage assembly embodying dish-shaped platforms.
Figure 9:
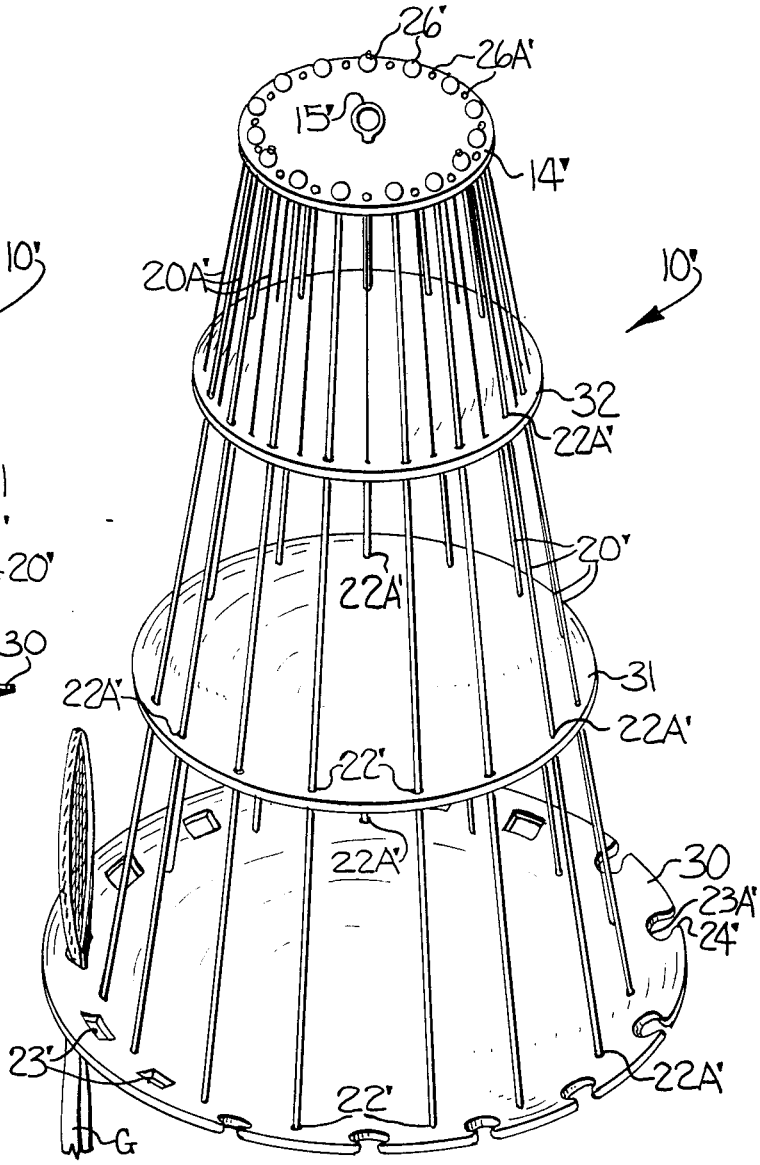
FIG. 9 is a perspective view of the storage assembly embodying dish-shaped platforms.

An alternative embodiment 10' is illustrated in FIGS. 8 and 9. All the elements and features of this embodiment 10' which are the same as those illustrated in the first embodiment 10 will bear the same reference numerals with a prime notation added to avoid repetitive description.

The embodiment 10' is provided with platforms 30–32 having concave upper surfaces. As shown, each of the platforms is of a concave dish-shaped configuration in order to assist in maintaining sports equipment such as balls C and D on the platforms 30–32. An advantage of this feature is that the balls will tend to collect in the central portion of the platforms. This embodiment is further provided with all the elongate pliable members being extensible pliable members 20', spaced apart adjacent the periphery of and cooperating with the platforms 30–32.

Abutment stops 17' are provided on at least three substantially equally spaced apart extensible pliable members 20' at locations corresponding to openings 22A depicted in FIG. 7, and are positioned under each of said platforms 30–32 for supporting the platforms 30–32 in substantially level position in the multitiered assembly.

Figures 10, 11:
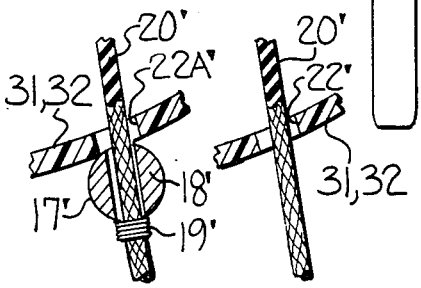
FIG. 10 is a sectional view, similar to FIG. 4, illustrating an abutment stop on an extensible member.
FIG. 11 is a sectional view illustrating an extensible member loosely guided in an opening of a dish-shaped platform of the storage assembly.

FIG. 11 depicts an extensible member 20'loosely passing through and guided by an opening 22' along the periphery of the platforms 30–32.

The invention may be suspended in any suitable location, preferably from a ceiling of a room or garage to more effectively utilize space. While in nonuse, the invention may be collapsed so that the platforms 11–13 or 30–32 are in a substantially nesting or stacked relationship so that the invention may be easily stored during nonuse.

Thus, it can be seen that this invention overcomes noted deficiencies of earlier mentioned prior art and it efficiently and effectively provides a suspendible storage assembly for organized containment of sports equipment during nonuse.

In the drawings and specification, there has been set forth preferred embodiments of the invention, and although specific terms are employed, they are used in a generic and descriptive sense only and not for purposes of limitation, the scope of the invention being defined in the claims.

That which is claimed is:

1. A suspendible storage assembly for containment of sports equipment such as basketballs, soccer balls, and tennis balls and the like during nonuse comprising:

(a) a plurality of vertically spaced apart platforms for supporting sports equipment thereon; and (b) a plurality of spaced apart elongate pliable supporting means cooperating with said platforms to maintain said platforms in multitiered assembly and to contain sports equipment on the platforms, and wherein at least some of said pliable supporting means are extensible and stretchable so as to be stretched and laterally deflected to facilitate passage of sports equipment therebetween and onto and from the platforms.

2. A suspendible storage assembly according to claim 1 wherein the centers of said platforms are in vertical alignment and said platforms are of decreasing size from the lowermost to the uppermost platform.

3. A suspendible storage assembly according to claim 1 wherein said plurality of elongate pliable supporting means are positioned adjacent the periphery of said platforms and are convergingly arranged from the lowermost platform to the uppermost platform.

4. A suspendible storage assembly according to claim 1 wherein each of said platforms has a circular row of openings spaced inwardly from the respective peripheries of the platforms and through which all said plurality of elongate pliable supporting means loosely extend so that said extensible and stretchable pliable supporting means may more freely be stretched and laterally deflected for facilitating passage of sports equipment therebetween.

5. A suspendible storage assembly according to claim 1 further comprising hook means carried by the lowermost platform and depending therefrom for suspendingly supporting other types of sports equipment during nonuse.

6. A suspendible storage assembly according to claim 1 wherein the lowermost platform has openings adjacent the periphery thereof adapted for receiving handles of bats and tennis rackets and the like therein for storage.

7. A suspendible storage assembly according to claim 6 wherein the lowermost platform has restricted access passageways communicatively connecting said openings to the periphery of said platform for facilitating placement of and removal of bat and racket handles and the like in the openings.

8. A suspendible storage assembly according to claim 1 further comprising means connected to the upper portions of said elongate pliable members and being adapted for suspending the storage assembly from a suitable support 9. A suspendible storage assembly according to claim 1 wherein at least three of said elongate pliable supporting means are inextensible and substantially uniformly spaced apart from each other and have correspondingly located abutment stops thereon so as to maintain said platforms in substantially level position.

10. A suspendible storage assembly for containment of sports equipment such as basketballs, soccer balls, and tennis balls and the like during nonuse comprising:

(a) a plurality of vertically spaced apart platforms for supporting sports equipment thereon, wherein at least one of said platforms have spaced apart apertures therein for receiving portions of balls so as to stabilize the balls and prevent them from freely moving about on the platform;

(b) at least three elongate inextensible pliable members substantially uniformly spaced apart from each other;

(c) abutment stop means on said inextensible elongate pliable members and positioned under each of said platforms at corresponding locations for supporting said platforms in substantially level position in a multitiered assembly; and (d) a plurality of elongate extensible and stretchable members positioned at spaced apart locations between said inextensible members and cooperating with said platforms to contain sports equipment on the platforms, and being adapted to be stretched and laterally deflected to facilitate passage of sports equipment therebetween and onto and from the platforms.

11. A suspendible storage assembly according to claim 10 wherein all of said platforms have ball receiving apertures for receiving portions of playing balls therein, and wherein the apertures in said lowermost platform are about 5 inches or less in diameter and wherein the apertures in platforms thereabove are of lesser diameter.

12. A suspendible storage assembly according to claim 10 wherein all of said platforms have ball receiving apertures and wherein the number of apertures in the uppermost platform are greater than the number of apertures in the lowermost platform and further, wherein said apertures in all the platforms are spaced inwardly of said extensible and stretchable and inextensible elongate members.

13. A suspendible storage assembly for containment of sports equipment such as basketballs, soccer balls, and tennis balls and the like during nonuse comprising:

(a) a plurality of vertically spaced apart platforms having concave upper surfaces for supporting sports equipment thereon, said concave surfaces serving to assist in maintaining sports equipment on said platforms inwardly from the periphery of the platforms;

(b) a plurality of spaced apart elongate extensible and stretchable pliable members cooperating with said platforms to contain sports equipment on the platforms and being adapted to be stretched and laterally deflected to facilitate passage of sports equipment therebetween and onto and from the platforms; and (c) abutment stop means on at least three substantially equally spaced apart extensible and stretchable elongate members at corresponding locations and positioned under each of said platforms for supporting said platforms in substantially level position in a multitiered assembly.

14. A suspendible storage assembly according to claim 10 or 13 wherein said plurality of platforms comprises at least three vertically spaced apart circular platforms the centers of which are in vertical alignment and are of progressively decreasing size from the lowermost platform to the uppermost platform.

15. A suspendible storage assembly according to claim 10 or 13 further comprising means connected to the upper portions of said pliable members and being adapted for suspending the storage assembly from a suitable support.

16. A suspendible storage assembly according to claim 10 or 13 wherein said abutment stop means comprises beadlike members, each with a bore therethrough and slidably mounted on said elongate members and means carried by said elongate members and positioned below said beadlike members for engagement therewith to limit the lowermost position of said beadlike members.

* * * * *